US007304589B2

(12) United States Patent
Kagawa

(10) Patent No.: US 7,304,589 B2
(45) Date of Patent: Dec. 4, 2007

(54) VEHICLE-TO-VEHICLE COMMUNICATION DEVICE AND METHOD OF CONTROLLING THE SAME

(75) Inventor: Masakazu Kagawa, Inuyama (JP)

(73) Assignee: Denso Corporation, Kariya (JP)

( * ) Notice: Subject to any disclaimer, the term of this patent is extended or adjusted under 35 U.S.C. 154(b) by 111 days.

(21) Appl. No.: 11/094,267

(22) Filed: Mar. 31, 2005

(65) Prior Publication Data

US 2005/0225457 A1 Oct. 13, 2005

(30) Foreign Application Priority Data

Apr. 9, 2004 (JP) ..... 2004-115587

(51) Int. Cl.
*G08G 1/123* (2006.01)

(52) U.S. Cl. ..... 340/995.13; 340/995.1; 701/208

(58) Field of Classification Search ..... 340/988, 340/989, 990, 997, 975.1, 995.12, 995.13, 340/995.17, 995.24, 995.27, 905; 701/208, 701/211, 213, 300, 117
See application file for complete search history.

(56) References Cited

U.S. PATENT DOCUMENTS 5,153,836 A * 10/1992 Fraughton et al. ..... 701/301
5,289,183 A * 2/1994 Hassett et al. ..... 340/905
5,428,544 A * 6/1995 Shyu ..... 701/117
6,150,961 A * 11/2000 Alewine et al. ..... 340/995.1
6,381,533 B1 * 4/2002 Crane et al. ..... 701/200
6,594,576 B2 * 7/2003 Fan et al. ..... 701/117
6,765,495 B1 * 7/2004 Dunning et al. ..... 340/903
2003/0225516 A1 * 12/2003 DeKock et al. ..... 701/214

FOREIGN PATENT DOCUMENTS

JP A-2000-339591 12/2000
JP A-2001-283381 10/2001
JP A-2002-183889 6/2002
JP A-2003-227867 8/2003
WO WO 2005/029438 * 3/2005

* cited by examiner

*Primary Examiner*—Brent A. Swarthout
(74) *Attorney, Agent, or Firm*—Posz Law Group, PLC

(57) ABSTRACT

A vehicle-to-vehicle communication device installed on a subject vehicle includes a detection function, a transmission function, a report function and a signal-processing function to display position information of surrounding vehicles as well as the subject vehicle. In a process of displaying the position information of the vehicles, the device communicates with the devices installed on other vehicles within a reach of the communication function to reflect the position information of the surrounding vehicles including vehicles not equipped with the device.

22 Claims, 7 Drawing Sheets

FIG. 3A

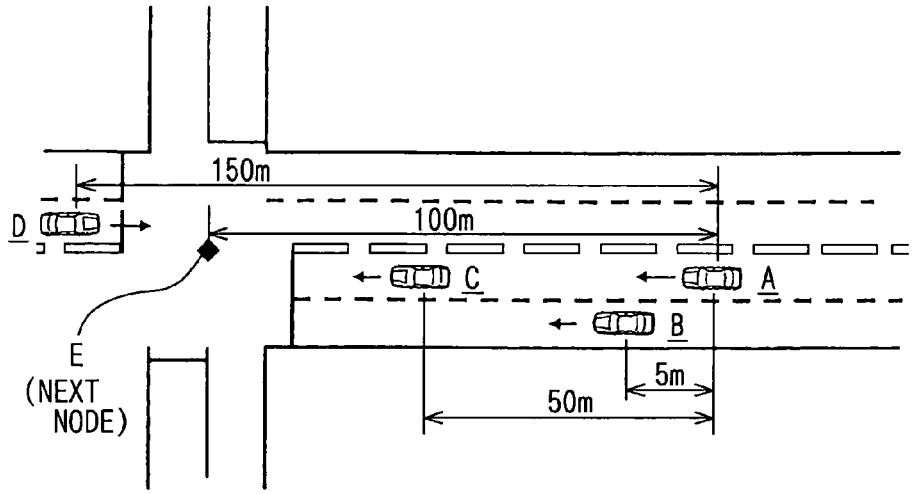

FIG. 3B

SUBJECT DEVICE INFORMATION SET FROM VEHICLE A

| | | |
|---|---|---|
| INFORMATION OF VEHICLE A | LOCATION | LONG. 137°03′E, LAT. 35°01′N |
| | NEXT NODE ID | 1001 |
| | DISTANCE | 100m |
| | TRAVELING DIRECTION | WEST |
| | SPEED | 30km/h |
| | LANE | RIGHT/2 |
| | CATEGORY | COMPACT |
| | ERROR | 1m |
| INFORMATION OF VEHICLE B | RELATIVE DISTANCE | 5m |
| | TRAVELING DIRECTION | SAME |
| | SPEED | 30km/h |
| | LATERAL DISTANCE | 3.5m LEFT |
| | ERROR | 1m |
| INFORMATION OF VEHICLE C | RELATIVE DISTANCE | 50m |
| | TRAVELING DIRECTION | SAME |
| | SPEED | 20km/h |
| | LATERAL DISTANCE | 0m |
| | ERROR | 2m |
| INFORMATION OF VEHICLE D | RELATIVE DISTANCE | 150m |
| | TRAVELING DIRECTION | OPPOSITE |
| | SPEED | 20km/h |
| | LATERAL DISTANCE | 3.5m RIGHT |
| | ERROR | 3m |
| OTHER INFORMATION | REFERENCE TIME | 12:34′56″789 |

VEHICLE-TO-VEHICLE COMMUNICATION DEVICE AND METHOD OF CONTROLLING THE SAME

CROSS REFERENCE TO RELATED APPLICATION

This application is based on Japanese Patent Application No. 2004-115587 filed on Apr. 9, 2004, the disclosure of which is incorporated herein by reference.

FIELD OF THE INVENTION

The present invention relates to a vehicle-to-vehicle communication device, and more specifically to a vehicle-to-vehicle communication system for detecting and reporting information of surrounding traffic through vehicle-to-vehicle communication.

BACKGROUND OF THE INVENTION

In recent years, vehicle-to-vehicle communication devices are used to determine vehicles that may possibly be affecting a subject vehicle's traveling condition by exchanging driver's intention in both ways between the subject vehicle and the affecting vehicle. For example, a conventional vehicle-to-vehicle communication device disclosed in Japanese Patent Document JP-A-2002-183889 captures a driver's voice indicating that the affecting vehicle should be stopping for a short time, and transmits a stop request to the affecting vehicle, when the subject vehicle having the vehicle-to-vehicle communication device enters into a traffic on a road from a shoulder of the road. More practically, the vehicle is determined by the device on the subject vehicle as possibly colliding with the subject vehicle. The device on the affecting vehicle having received the stop request displays positions of the affecting vehicle and the subject vehicle requesting a stop on a display of the device to inform the driver of the affecting vehicle of the stop request.

If a driver of the affecting vehicle responds to the stop request by indicating an acknowledgement by voice, the device on the affecting vehicle sends back the acknowledgement to the device on the subject vehicle. The device on the subject vehicle entering the traffic with the acknowledgement having received from the affecting vehicle also displays the positions of the subject vehicle and the affecting vehicle on the display of the device to inform the driver of the subject vehicle of reception of the acknowledgement of the stop request.

However, the vehicle-to-vehicle communication device is not necessarily installed on all of the vehicles on the road. That is, the driver of the subject vehicle cannot get hold of the position of the affecting vehicle by the communication between the devices if the affecting vehicle does not have the device. For example, in a situation having three vehicles A, B and C involved, where the device-equipped vehicle A is stopping at a shoulder of a main street for entering traffic on the main street from a side road, and the device-equipped vehicle B and the device-not-equipped vehicle C are traveling on the main street, a driver of the vehicle A can only get hold of the precise position of the vehicle B by using the device, and can recognize the position of the vehicle C only by sight if it exists in a viewable area of the driver of the vehicle A.

SUMMARY OF THE INVENTION

It is therefore an object of the present invention to provide a vehicle-to-vehicle communication device and its controlling method for the benefit of a driver of a vehicle equipped with the device to acquire information even of a vehicle not having the vehicle-to-vehicle communication device as accurately as possible.

The vehicle-to-vehicle communication device is organized to serve as a system for detecting, communicating, processing and reporting information of plural vehicles. The vehicle-to-vehicle communication device installed on each vehicle communicates each other, to firstly detect and transmit information of a subject vehicle's state and one or more surrounding vehicles' state collected by a detection function and a communication function, and then to process and report the information of the surrounding vehicles' state received from the other devices with the information of the subject vehicle's state detected by the device on the subject vehicle by a signal-processing function, and to report processed information by a report function.

The vehicle-to-vehicle communication system of the present invention can even get hold of information (e.g., a position) of the vehicle not equipped with the vehicle-to-vehicle communication device as well as the vehicle with the device. It is because of the detection function of the vehicle-to-vehicle communication device of the present invention that detects not only the information of the subject vehicle but also the information of its surrounding vehicles. Further, it is because of the signal-processing function and the report function of the vehicle-to-vehicle communication device that processes and reports not only the information about the subject vehicle but also the information of the surrounding vehicles received by the communication function of the device.

That is, the vehicle-to-vehicle communication device collects the information of surrounding vehicles generated by, for example, a radar device, an onboard camera, or the like, not only from the subject vehicle but also from other vehicles equipped with the vehicle-to-vehicle communication device. The information from other devices are processed and reported to the subject vehicle's driver. Therefore, in a situation where a vehicle B is running in a hidden position from the driver on a vehicle A, the vehicle B can be recognized by a driver of the vehicle A, if only the vehicle-to-vehicle communication device on a nearby vehicle C detects and transmits the information of the vehicle B to the device on the vehicle A. As a result, the driver of the vehicle A can recognize a wide range of surrounding traffic, and thus safety of driving is improved.

In the present invention, the detection function of the device preferably detects position information of the vehicles. Further, the signal-processing function of the device preferably processes the position information of the vehicles to determine and display the positions of the surrounding vehicles together with the subject vehicle on a map data retrieved by a map data retrieval function. The positions of the vehicles on the map are represented by representation such as icons or the like. In this manner, the driver of the subject vehicle can immediately get hold of the information of the surrounding vehicles when he/she sees the icons on the display.

Further, the signal-processing function of the device may preferably estimate the positions of the vehicles either at present (the moment of display) or after a predetermined period of time, instead of determining the vehicle positions at the moment of detection. That is, the detection function detects the speed of the vehicles including the subject vehicles and the surrounding vehicles, and the signal-processing function estimates the positions of the vehicles either at a moment of reporting or after a predetermined period of time from a moment of detection based on the position information and the speed information from both of the devices on the subject vehicle and the surrounding vehicles.

In this manner, the device can take a time difference, e.g., on the order of milliseconds, between the detection of the vehicles and the display of the icons into account. Further, ordinary people require a certain period of recognition time to consciously recognize visual information after being visually exposed to information, especially when an amount of the visual information is large. This may lead to a problem that the recognized visual information substantially departs from a real traffic condition when the required period of the recognition time is large. However, the vehicle-to-vehicle communication device with the signal-processing function capable of estimating the position information after a predetermined period of time, i.e., after 1 second, 3 seconds or the like, can efficiently manage the above problem.

The position information from the detection function of the vehicle-to-vehicle communication device practically includes a certain amount of error. Therefore, the positions of the vehicles are preferably displayed after error correction. That is, the signal-processing function of the device preferably uses plural sets of the position information for each of the vehicles derived from different sources with different weighting of accuracy to determine the position of each vehicle when the information is available from the different sources. In this case, the different sources of the position information include the detection function of the device on the subject vehicle and components used in the detection function such as sensors, radars and the like. Further, 'to use plural sets of the position information of each vehicle derived from different sources with different weighting of accuracy' means that the positions of the vehicles are determined in the following manner. That is, a position information A (Xa, Ya) with an error range of 10 m in radius, and a position information B (Xb, Yb) with an error range of 5 m in radius, are combined to give the coordinates of the vehicle position using the formulae below. In this case, presumption of the coordinates is such that Xb is greater than Xa (Xb>Xa), and Yb is greater than Ya (Yb>Ya).

(Formulae)

$$X=Xa+(Xb-Xa)*10/15$$

$$Y=Ya+(Yb-Ya)*10/15$$

In this manner, an accurate information is prioritized than a less accurate information to give better (more realistic) estimation result.

The position information with an error equal to or more than a predetermined amount may preferably be disregarded and not used for the calculation of the vehicle positions. This prevents the vehicle positions from including an excessively large amount of error.

The position information with an error equal to or less than a predetermined amount, on the contrary, may exclusively be used for determination of the vehicle positions. This prevents the highly accurate vehicle positions from being worsened by less accurate information used in determining the vehicle positions.

The error in the position information may cause the icons of the vehicles displayed in a wrong lane of the road on the map, depending on the order of the error. Therefore, the signal-processing function of the vehicle-to-vehicle communication device preferably checks moving directions of the vehicle icons on the map against attributes of the map data retrieved by the map data retrieval function. The positions of the vehicle icons may be shifted to realistically simulate the positions of the vehicles when, for example, the vehicle icons are moving against the vehicular lanes of the road. This prevents the vehicle icons from moving against real traffic conditions, and thus the vehicle icons closely simulate the real traffic conditions.

The error in the position information may also cause one or more of the vehicle icons displayed on top of the other icons, depending on the order of the error. This leads to a problem that each vehicle icon cannot be clearly distinguished on the map. Therefore, the signal-processing function of the vehicle-to-vehicle communication device preferably checks that an area of one vehicle icon does not interfere with areas of other vehicle icons. The positions of the vehicle icons may be shifted in order not to interfere with each other for clearness of display. This solves the problem of piled up vehicle icons on the map, and thus the vehicle icons are clearly distinguished. This also helps the device to closely simulate the real positions of the vehicles.

The vehicle-to-vehicle communication device of the present invention can let the driver of a first vehicle know a second vehicle not equipped with the device and hidden from the eyes of the driver, if only the second vehicle is detected by the detection function of the device installed on a third vehicle. However, the position of the hidden vehicle (not equipped with the device) practically contains larger amount of errors compared to the position of the vehicle equipped with the device. Therefore, the vehicles with the device and without the device are preferably represented differently on the display.

That is, the signal-processing function of the device preferably uses different icons for vehicles with the device and without the device respectively on the display. This prepares the driver of the subject vehicle to take different responses for the vehicles in terms of installation of the device.

The vehicle-to-vehicle communication device of the present invention may directly communicate with the device on other vehicles by, for example, using a wireless communication, or may indirectly communicate with the device on other vehicles with assistance of road-side communication devices installed on road sides.

The vehicle-to-vehicle communication device of the present invention may further communicate with the device on the other vehicle with assistance of a third device on a different vehicle. This enables the device to communicate with the device beyond its communication range.

The vehicle-to-vehicle communication system of the present invention described above may implement each of the functions described above as a combination of the plural devices.

The signal-processing function of the vehicle-to-vehicle communication system of the present invention may be implemented as a signal-processing device having required functions.

BRIEF DESCRIPTION OF THE DRAWINGS

Other objects, features and advantages of the present invention will become more apparent from the following detailed description made with reference to the accompanying drawings, in which:

FIG. 3A is a schematic diagram as an example of vehicle positions according to the embodiment;

FIG. 3B is a table of subject device information set as an example according to the embodiment;

DETAILED DESCRIPTION OF THE PREFERRED EMBODIMENTS

Figure 1:
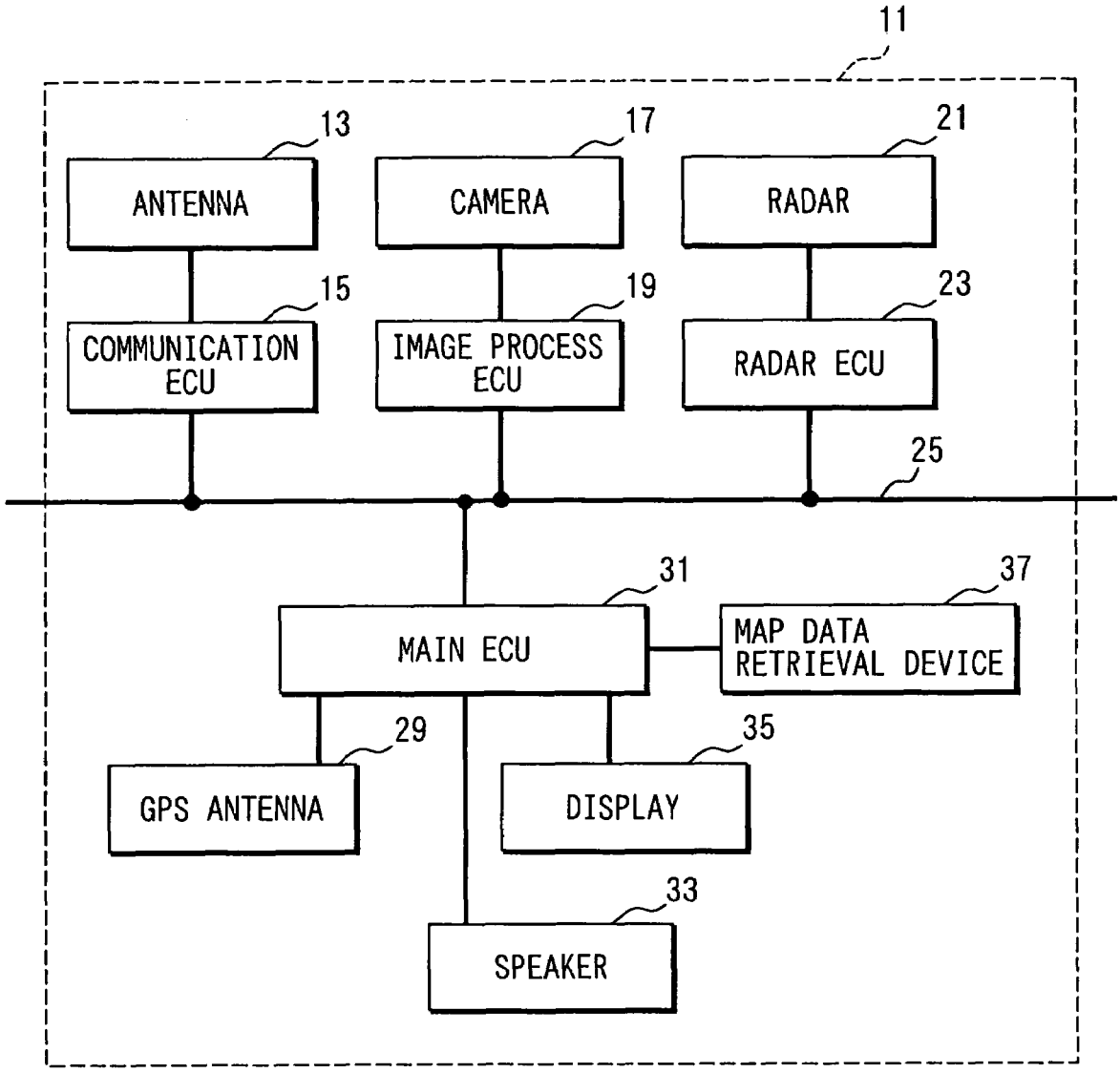
FIG. 1 is a schematic block diagram of a vehicle-to-vehicle communication device according to an embodiment of the present invention.

A vehicle-to-vehicle communication device 11 includes, as shown in FIG. 1, a antenna 13, a communication ECU 15, a camera 17, an image process ECU 19, a radar 21, a radar ECU 23, a vehicle LAN 25, a GPS antenna 29, a main ECU 31, a speaker 33, a display 35, and a map data retrieval device 37.

The antenna 13 transmits and receives a radio wave to communicate with other vehicle-to-vehicle communication device 11, and is controlled by the communication ECU 15. A transmission scope of the radio wave output from the antenna 13 reaches from a few dozens to several hundreds meters.

The communication ECU 15 generates transmission signals based on a data provided by the vehicle LAN 25, and transmits the signals to other vehicle-to-vehicle communication devices 11 from the antenna 13 as the radio wave. The communication ECU 15 also controls reception of signals from other vehicle-to-vehicle communication devices 11 based on the data from the antenna 13, and outputs the restored data to the vehicle LAN 25.

The camera 17 having an image sensor captures an image of an area in front of a subject vehicle with the vehicle-to-vehicle communication device 11, and sends it to the image process ECU 19.

The image process ECU 19 analyzes the image received from the camera 17, extracts position information of vehicles captured in the image, and outputs the information to the vehicle LAN 25.

The radar 21 transmits a millimetric wave or a laser toward an area in front of the subject vehicle with the vehicle-to-vehicle communication device 11, and receives reflection from an object in front of the subject vehicle.

The radar ECU 23 calculates a distance to an object in front of the subject vehicle based on an elapsed time between transmission and reception of the millimetric wave, the laser or the like, as well as controlling the radar 21. A calculation result is sent out to the vehicle LAN 25 as a data.

The GPS antenna 29 receives radio waves from GPS satellites. A received signal is output to the main ECU 31. The speaker 33 outputs various types of warning sounds and voices.

The display 35 uses a liquid crystal display device, an organic electro-luminescence display device or the like, to display an image of a map. The map data retrieval device 37 retrieves a map data from a map data storage media (e.g., a DVD-ROM disk, a hard disk, or the like), and sends the map data to the main ECU 31.

The main ECU 31 calculates a position of the subject vehicle based on the signal from the GPS antenna 29. The main ECU 31 receives and transmits various kinds of information to and from the vehicle LAN 25 to control each ECU connected to the vehicle LAN 25 by executing each process described later. The main ECU 31 controls the speaker 33, the display 35, and the map data retrieval device 37.

The system 11 performs a transmission process, a reception process, a display refresh process and the like under the control of the main ECU 31 as follows.

(Transmission Process)

Figure 2:
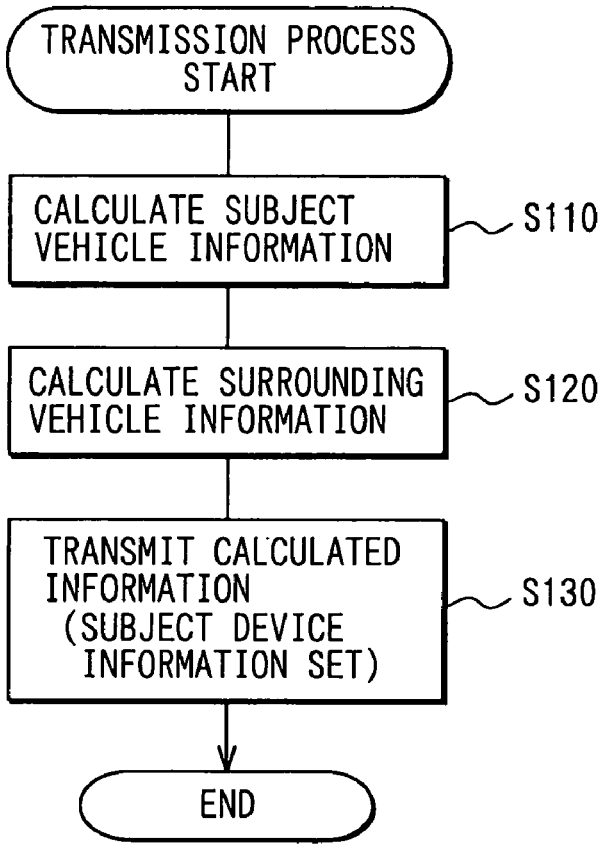
FIG. 2 is a flowchart of a transmission process according to the embodiment.

The main ECU 31 repeats the transmission process at a predetermined interval (e.g., once in every second). The transmission process may be executed under an instruction from other vehicle-to-vehicle communication device 11. A whole procedure of the transmission process is shown as a flowchart in FIG. 2.

The operation of the transmission process starts with a calculation of information of the subject vehicle having the vehicle-to-vehicle communication device 11 (step S110). The information of the subject vehicle is calculated based on the various kinds of information collected from the other ECUs connected to the vehicle LAN 25, and/or based on the data from the map data retrieval device 37.

In the next step (step S120), the transmission process calculates information of surrounding vehicles around the subject vehicle. The information of the surrounding vehicles is calculated based on the various kinds of information collected from the other ECUs connected to the vehicle LAN 25.

In the next step (step S130), the transmission process transmits the information calculated in the steps S110 and S120 to the surrounding vehicles. The transmission of the information occurs simultaneously to the multiple surrounding vehicles. This step concludes the transmission signal-processingled by the main ECU 31.

An example of a table of a subject device information set and each entry of the information set used in the transmission process are described with reference to a drawing and a table in FIGS. 3A and 3B.

A schematic diagram in FIG. 3A shows positions of vehicles involved in an example of traffic on a two-lane (each direction) road in the proximity of an intersection. Provided that a vehicle A has the vehicle-to-vehicle communication device 11 as a subject vehicle, the information calculated in the step S110 in FIG. 2 may be a subject vehicle information portion of the information table shown in FIG. 3B. The information entries include, "longitude 137°03' E, latitude 35°01' N" as a location of the vehicle A, "1001" as an ID of a next node (an intersection E), "100 m" as a distance to the next node (the intersection E), "west" as a traveling direction of the vehicle A, "30 km/h" as a speed of the vehicle A, "right lane/2" as a vehicle's traveling lane and total number of lanes on each side, "compact" as a vehicle category (other categories include, for example, emergency vehicle, priority vehicle and the like) and "1 m" as an error of the vehicle A position.

The other part of the information table in FIG. 3B show the information of the surrounding vehicles B to D calculated in the step S120. That is, the information of the vehicle B includes, for example, "5 m" as a relative distance to the subject vehicle (vehicle A), "same" as a traveling direction relative to the subject vehicle, "30 km/h" as a speed, "3.5 m left" as a lateral distance to the subject vehicle, and "1 m" as an error.

The information mentioned as the "subject device information set" is organized in the above-described manner, and is transmitted to the surrounding vehicles together with a reference time that records the time of the information generation. The transmission of the information set concludes the transmission process by the main ECU 31.

(Reception Process)

Figure 4:
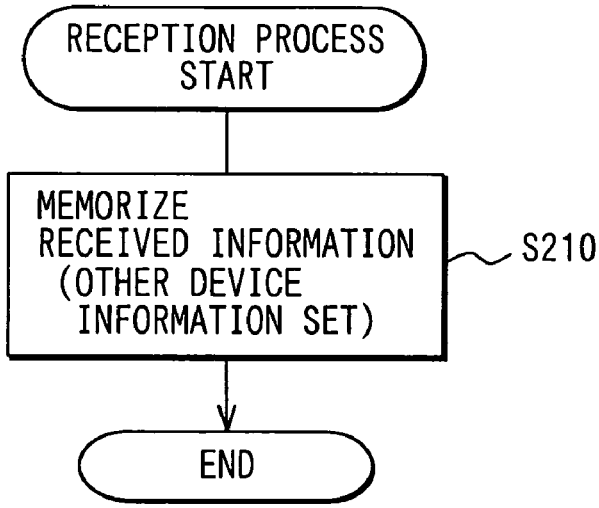
FIG. 4 is a flowchart of a reception process according to the embodiment.

The reception process under the control of the main ECU 31 is described with reference to a flowchart shown in FIG. 4.

The main ECU 31 executes the reception process when the main ECU 31 is receiving the information (other device information set) generated in the other vehicle-to-vehicle communication device 11.

The other device information set is the information sent out from the other vehicle-to-vehicle communication device 11 as a result of the transmission process described above.

In the reception process, the main ECU 31 stores the other device information set received from other vehicle-to-vehicle communication devices 11 through the transmission ECU 15 (step S210), and then concludes the reception process. As a result, the main ECU 31 stores one or more sets of information as shown in FIG. 3B. Each set of the other device information stored in the main ECU 31 is associated with the device 11 that has calculated and prepared the information on other vehicles.

(Display Refresh Process)

Figure 5:
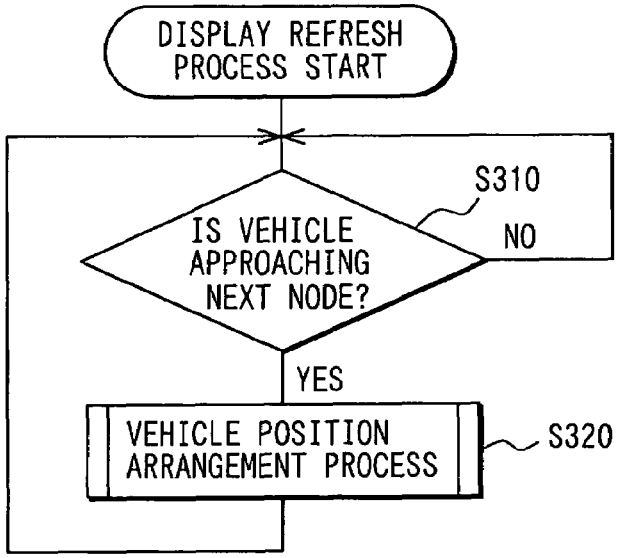
FIG. 5 is a flowchart of a display refresh process according to the embodiment.

Next, a display refresh process is described with reference to a flowchart shown in FIG. 5.

The main ECU 31 starts an operation of the display refresh process after an ignition switch (not shown) of the subject vehicle is turned on, if setting is so configured. The operation of the process may also be started under an instruction from an occupant of the subject vehicle by operating an operation portion of the device 11 (not shown in FIG. 1) after the ignition switch of the subject vehicle is turned on. In the operation of the display refresh process, the main ECU 31 substantially executes a "vehicle position arrangement process."

After starting the operation of the display refresh process, the main ECU 31 determines if the subject vehicle is approaching a next node (step S310). The "next node," in this case, is a critical point such as an intersection, a branch point or the like. At and around one of those nodes, the information of the surrounding vehicles is in greater demand for safe driving of the subject vehicle, compared to the other part of the road. The subject vehicle is determined as "approaching a node" when, for example, the distance to an intersection is less than 100 m.

The display refresh process proceeds to the vehicle position arrangement process (step S320) when the subject vehicle is determined as approaching the node by the main ECU 31 (step S310: Yes). The display refresh process repeats the determination step S310 if the subject vehicle is determined as not approaching the next node (step S310: No).

Figure 6:
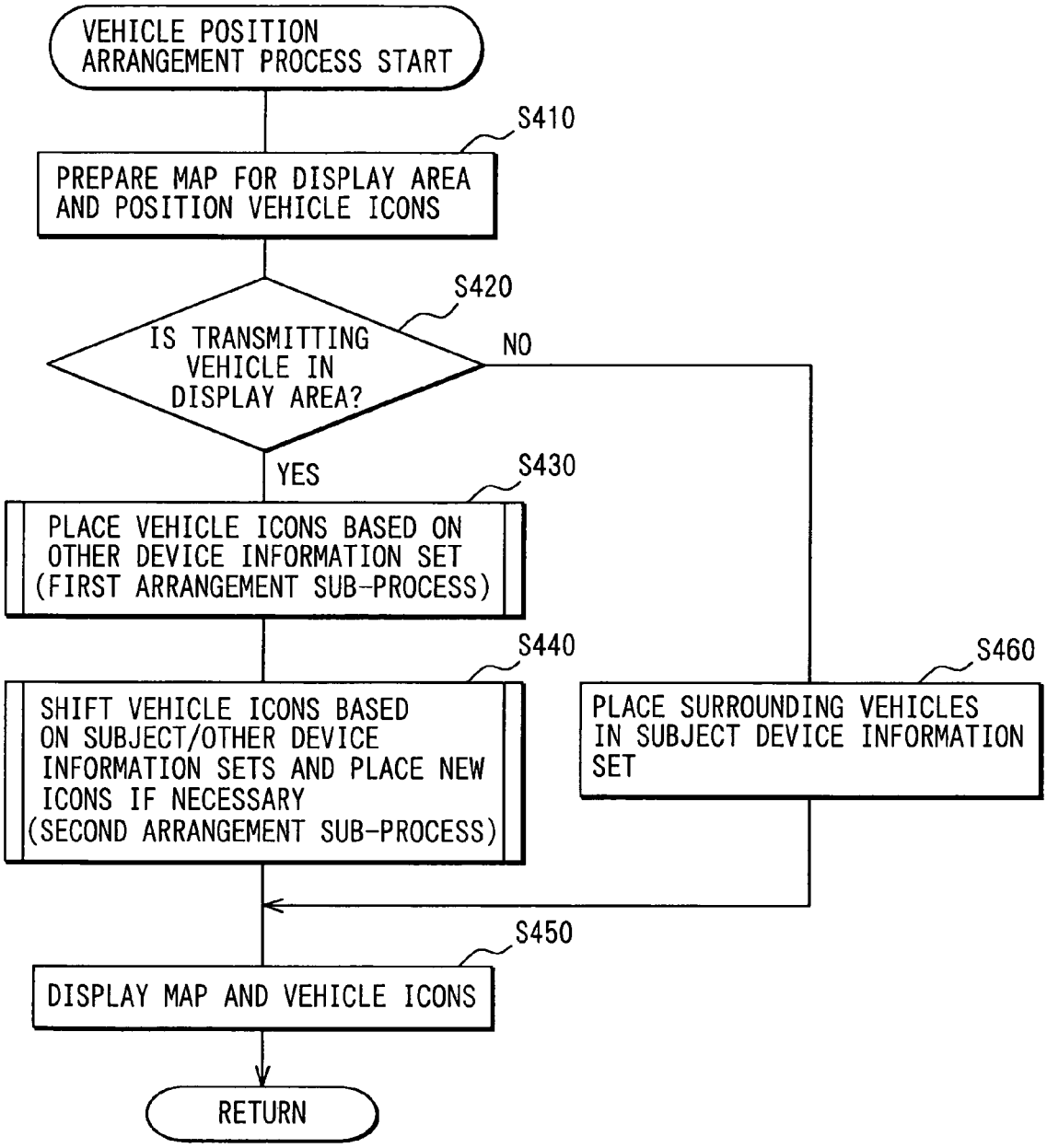
FIG. 6 is a flowchart of a vehicle position arrangement process according to the embodiment.

The vehicle position arrangement process is executed in step S320. The process is described with reference to a flowchart shown in FIG. 6.

The vehicle position arrangement process starts with map image generation for a display area (an area around the next node) and vehicle image positioning on the prepared map image based on the subject device information set (step S410). In this process, the subject vehicle with the vehicle-to-vehicle communication device 11 is displayed on the map based on the position information detected by the device 11 on the subject vehicle. The display area of the map image is prepared for the display 35 by clipping a portion of the map data around the next node. The map data is retrieved from the map data storage media by the map data retrieval device 37. The vehicle position arrangement process described in the steps here (steps S410, S420, S430, S440 and S460) is not an act of displaying image on the display 35, but an operational process in a memory of the main ECU 31.

The vehicle position arrangement process, in the next step (step S420), determines if the transmitting vehicle having transmitted the other device information set exists in the display area. That is, if the location of the transmitting vehicle in the subject vehicle information portion on the information table received by the reception process as an other device information set is within the display area, the vehicle is determined as existing in the display area. (Refer to the example shown in FIG. 3B) When the transmitting vehicle is in the display area (step S420: Yes), the process proceeds to step S430. When the vehicle is not in the display area (step S420: No), the process branches out to step S460.

In step S430, the icon of the transmitting vehicle is placed on the map (a first arrangement sub-process). Detail of this sub-process is described later.

After the placement of the vehicle icon in step S430, step S440 is executed. In step S440, the vehicle positions already placed on the map are shifted for accuracy of display based on the subject device information set and the other device information set received from other vehicles. In this case, the information of the subject vehicle contained in the other device information set having been received by the subject vehicle is not used in the calculation for shifting. If no vehicle icon that matches any entry of the other device information set is found on the map, a new vehicle icon is placed on the map (a second arrangement sub-process).

Next, in step S460, a branch destination of step S420 when there is no transmitting vehicle in the display area, the vehicles other than the subject vehicle in the subject device information set are placed on the map. With reference to FIG. 3A, vehicles B through D are placed on the map in correspondence with the other vehicles.

After arrangement of the vehicles in the above-described manner, the vehicle icons and the map image are displayed on the display 35 based on the information stored in the memory of the main ECU 31 (step S450). This concludes the vehicle position arrangement process, and the operation of the device may return to the display refresh process, or to a process that the display refresh process was switched from.

(First Arrangement Sub-process)

Figure 7:
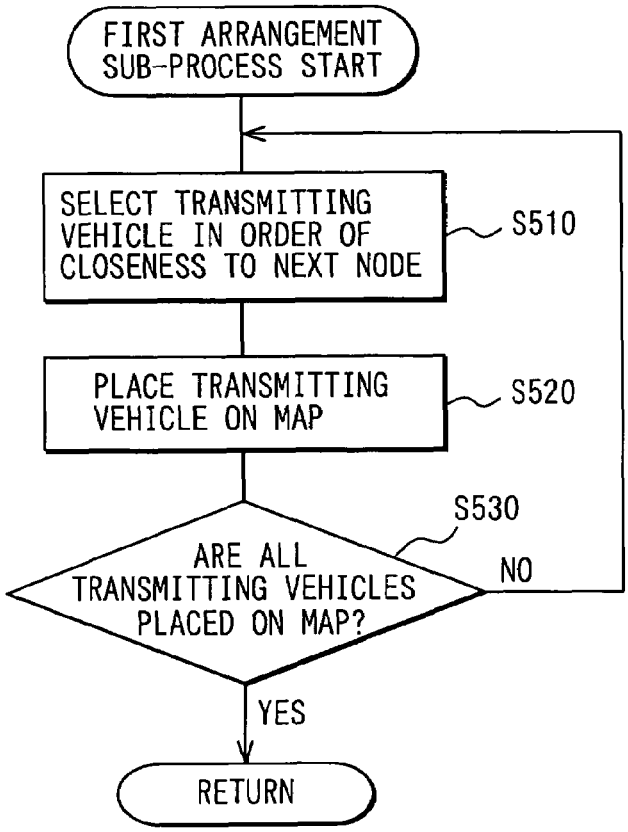
FIG. 7 is a flowchart of a first arrangement sub-process according to the embodiment.

The first arrangement sub-process in the step S430 is described with reference to a flowchart in FIG. 7. The first arrangement sub-process starts with selecting a transmitting vehicle to be placed on the map in an order of the closeness to the next node (step S510). This selection is based on the location of the subject vehicle in the subject vehicle information portion on the information table in the other device information set and the position information of the next node.

Then, the selected vehicle is placed on the map (step S520) based on the location information.

Then, the process determines if all the transmitting vehicles are placed on the map (step S530). The first arrangement sub-process keeps returning to step S510 until all the transmitting vehicles are placed on the map data. When all of the transmitting vehicles are placed on the map data, the first arrangement sub-process concludes, and the operation of the device 11 proceeds to the second vehicle position arrangement process in the step S440 shown in FIG. 6.

(Second Arrangement Sub-process)

Figure 8:
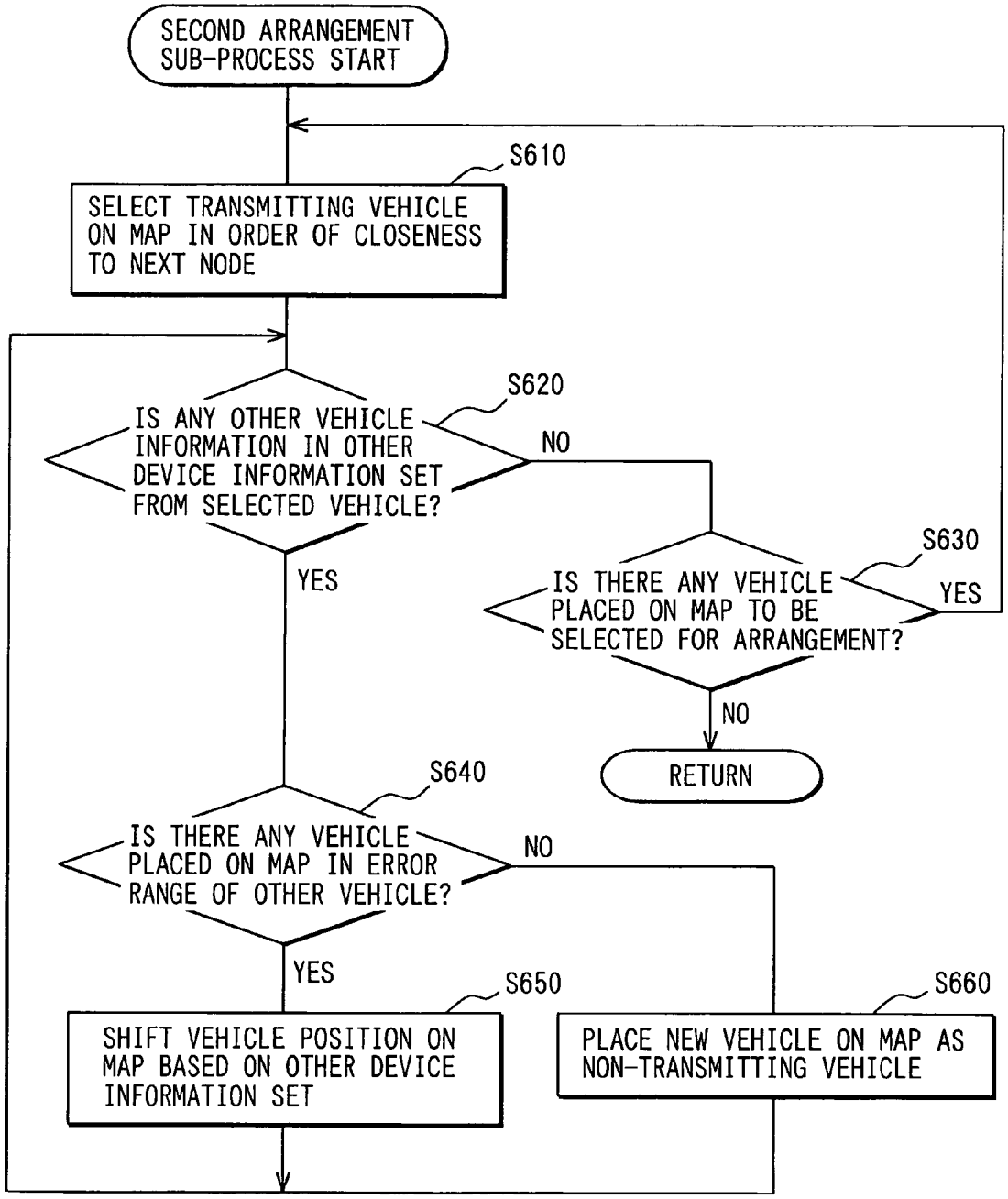
FIG. 8 is a flowchart of a second arrangement sub-process according to the embodiment.

The second arrangement sub-process is described with reference to a flowchart in FIG. 8. The second arrangement sub-process in the step S440 starts with selecting a vehicle already placed on the map in an order of the closeness to the next node (step S610). Then, the process determines if there is other vehicle's information in the other device information set having been received from the selected vehicle (step S620). When the other vehicle's information exists in the other device information set, the process proceeds to step S640. When the other vehicle's information does not exist, the process branches out to step S630.

In step S640, the location of the vehicle contained in the other vehicle's information found in step S620 is checked against the other already-placed vehicle. The location described here is named as a "focus location." The process determines if there is other already-placed vehicle within an error range of the focus location. When there is an already-placed vehicles in the error range of the focus location, the process proceeds to step S650. When there is no already-placed vehicle in the error range of the focus location, the process branches out to step S650.

In step S650, the position of the already-placed vehicle is shifted based on the focus location. More practically, the position of the vehicle is shifted in the following manner. That is, for example, when an already-placed vehicle is in a position A (Xa, Ya) with an error range of 1 m, and a focus location is in a position B (Xb, Yb) with an error range of 5 m, the shifted position of the already-placed vehicle is calculated using the following formulae. In this case, presumption of the coordinates is such that Xb is greater than Xa (Xb>Xa), and Yb is greater than Ya (Yb>Ya).

(Formulae)

$$X=Xa+(Xb-Xa)*1/6$$

$$Y=Ya+(Yb-Ya)*1/6$$

The shifted position may be calculated by other method that properly weights the error range. After shifting the position of the vehicle, the process returns to step S620.

In step S660, a branch destination when there is no already-placed vehicle, the focus location is determined as a position of a non-transmitting vehicle (a vehicle that has not transmitted the other device information set). A new vehicle is placed on the focus location. Then, the process returns to step S620.

In step S630, a branch destination when there is no other vehicle's information in the other device information set received from the selected vehicle, the process determines if there is an already-placed vehicle not yet selected. When there is an already-placed vehicle to be selected, the process returns to step S610. When there is no such vehicle, the second arrangement sub-process concludes and the operation of the device 11 proceeds to the step S450 of the vehicle position arrangement process shown in FIG. 6.

The vehicle-to-vehicle communication devices 11 organized as a system can get hold of the position of the vehicle that is not equipped with the device 11. It is because the device 11 calculates not only the position information of the vehicle equipped with the device 11 but also the position information of the vehicle of the surrounding vehicles based on the information captured by the camera 17, the radar 21 and the like. The position information calculated by one device 11 is transmitted to other devices 11 through the transmission antenna 13, and the main ECU 31 in the device 11 on the receiving side processes and displays all the information collected by the devices 11. As a result, the driver of the subject vehicle can get hold of the traffic condition, including the subject vehicle, the surrounding vehicles equipped with the device 11, and the surrounding vehicles not equipped with the device 11.

Figure 9:
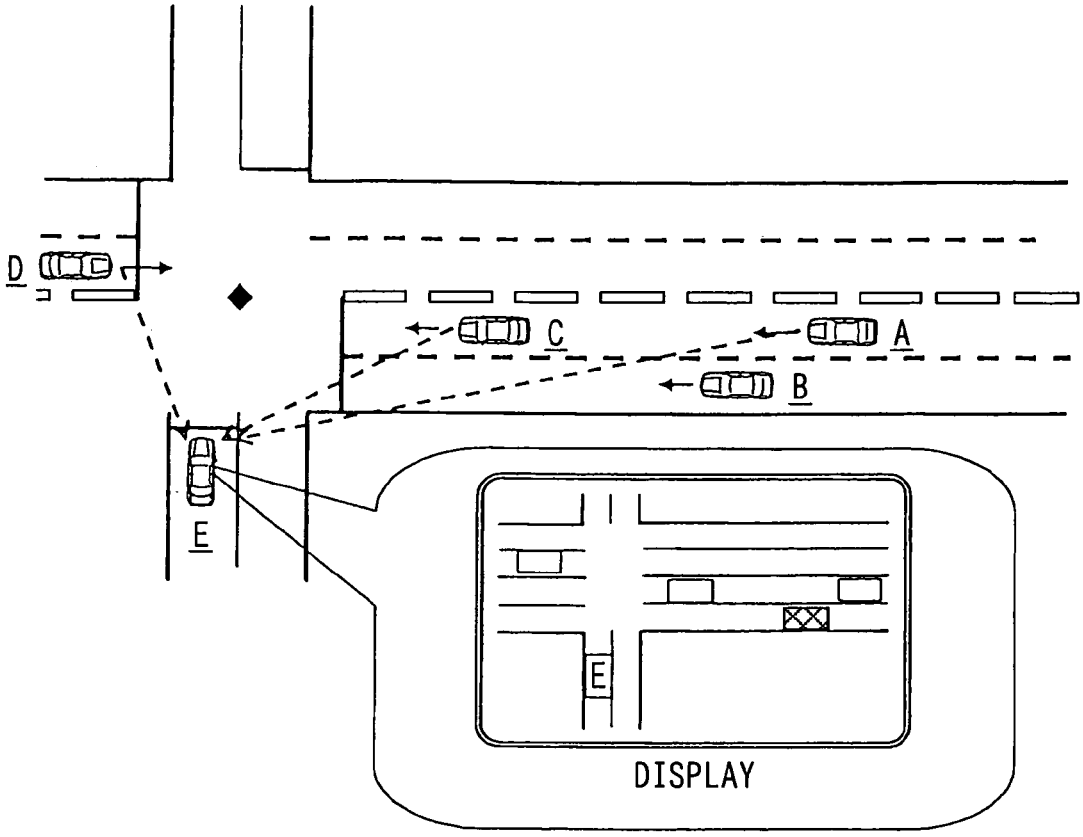
FIG. 9 is a schematic diagram of vehicle positions on a road and a corresponding display as an example of the embodiment.

An example of a traffic condition is schematically shown in FIG. 9. In the figure, vehicles A, B, C, D and E are on the road, and the vehicle A, C, D and E are equipped with the same device as the device 11. When the vehicle E is supposed to be a focus of this example, or a "subject vehicle," the device 11 operates in the following manner. That is, the device 11 on the vehicle E receives information from the devices 11 on the vehicles A, C and D. The information of the vehicle B is, in this case, included in the information from the vehicle A. Therefore, the device 11 on the vehicle E displays not only the positions of the vehicle A, C, D and E, but also the position of the vehicle B. The vehicle B is preferably displayed in a different manner from other vehicles, because it is not equipped with the vehicle-to-vehicle communication device 11.

Consequently, the vehicle-to-vehicle communication device 11 can get hold of the vehicle not equipped with the device 11, and the device 11 improves safety of driving of the vehicle having the device 11 thereon.

OTHER EMBODIMENT

Although the present invention has been fully described in connection with the preferred embodiment thereof with reference to the accompanying drawings, it is to be noted that various changes and modifications will become apparent to those skilled in the art.

For example, the position of the vehicle icons may preferably be advanced in the traveling direction of the vehicle on the map when the difference between the reference time in the detected information and the current time (the time of the display) is large. The position is estimated based on the speed of the vehicle and the difference of those times. The error range of the estimated vehicle position is preferably increased proportionally to the time difference. In this manner, the driver can get hold of more accurate positions of the vehicles.

The positions of the vehicle icons are preferably advanced on the map based on the time lag between visual perception and conscious recognition of the icons by the driver. The time lag between the perception and the recognition may be canceled when the position of the vehicle icons are advanced by, for example, one second, three seconds or the like. This makes it easier for the driver of the vehicle to use the displayed information of the surrounding vehicles.

The position information having an error equal to or more than a predetermined amount may not be used by the device. The position information with higher accuracy, such as a real-time kinematic GPS or the like, may be prioritized than other less accurate information to maintain the accuracy of highly accurate information. (step S650 in FIG. 8)

The vehicle icons may be shifted and rearranged for more suitable display on the map. That is, the icons shown on the map are not necessarily running on correct vehicular lanes of the road because of the errors contained in the position information of the vehicles. Also, the vehicle icons may be piled up on one another on the map for the same reason.

The shifted and rearranged icons help the driver of the subject vehicle get hold of a more realistic traffic situation, and thus the device contributes to safety of driving. The re-arrangement and shifting of the vehicle icons are achieved by calculation in the first and second arrangement sub-processes.

The vehicle-to-vehicle communication device may preferably communicate with other device with an assistance of a road-side device installed on a road side. This helps the device expand its communication range, and makes the device accept greater amount of information from number of the devices on other vehicles.

The vehicle-to-vehicle communication system may implement each of the functions described above as a combination of the plural devices. That is, one of the plural devices (a first device) may detect the positions of the vehicles, while a second device on a different vehicle may calculate the positions of the vehicles and a third device on yet another vehicle may display the positions of the calculated positions with communication of information between the devices.

The signal-processing function of the vehicle-to-vehicle communication system may be implemented as a signal-processing device having required function for signal-processingling. That is, the signal-processing function of the system may be concentrated and executed on the signal-processing device on one vehicle or may be executed on the signal-processing devices on plural vehicles.

Such changes and modifications are to be understood as being within the scope of the present invention as defined by the appended claims.

What is claimed is:

1. A vehicle-to-vehicle communication device installed on a subject vehicle and organized with one or more vehicle-to-vehicle communication devices as a system, the vehicle-to-vehicle communication device comprising:

a detection means for detecting first information of the subject vehicle and each of surrounding vehicles around the subject vehicle;

a communication means for receiving second information of surrounding vehicles from another vehicle-to-vehicle communication device;

a report means for reporting various kinds of information;

a signal-processing means for processing the first information of the subject vehicle and of the another communication device and for making the report means report the information of the subject vehicle and each of the surrounding vehicles; and a map data retrieval means for retrieving map data;

wherein the detection means detects information of positions of the subject vehicle and each of the surrounding vehicles, wherein the report means includes a display means for displaying the various kinds of information as an image, wherein the signal-processing means processes and determines the position of the subject vehicle and the positions of each of the surrounding vehicles based on the information from the detection means of the vehicle-to-vehicle communication devices on the subject vehicle and other vehicles, wherein the signal-processing means controls the display means to display representation of the subject vehicle and each of the surrounding vehicles in an image of the map data when the image is processed by the signal-processing means with the map data retrieved by the map data retrieval means, and wherein the signal-processing means prioritizes the information of positions of the vehicles from plural information sources, when plural sources are available, with accuracy weighting of the sources in processes of position estimation of the vehicles.

2. The vehicle-to-vehicle communication device of claim 1, wherein the detection means detects information of speed of the subject vehicle and each of the surrounding vehicles, and wherein the signal-processing means gives position estimations of the subject vehicle and each of the surrounding vehicles based on the positions and the speeds of the subject vehicle and each of the surrounding vehicles detected by the detection means so that the position estimations of the subject vehicle and each of the surrounding vehicles reflect movement of the vehicles in a predetermined period of time from a moment of detection.

3. The vehicle-to-vehicle communication device of claim 1, wherein the signal-processing means gives each position estimation of the vehicles solely with the information of the position of each vehicle having an error of less than a predetermined amount.

4. The vehicle-to-vehicle communication device of claim 1, wherein the signal-processing means gives each position estimation of the vehicles exclusively with a specific source of information when the specific source of information has higher accuracy than a predetermined level.

5. The vehicle-to-vehicle communication device of claim 1, wherein the signal-processing means controls the positions of the representation of the vehicles so that traveling directions of the representation of the vehicles follow traffic direction of a portion of the image of the map data where the representation of the vehicles are positioned.

6. The vehicle-to-vehicle communication device of claim 1, wherein the signal-processing means controls the position of the representation of the vehicles so that the representation of each vehicle does not interfere with each other in the image of the map data.

7. The vehicle-to-vehicle communication device of claim 1, wherein the communication means of the device communicates with the device installed on the other vehicle with an assistance of a roadside device that relays communication between the devices.

8. The vehicle-to-vehicle communication device of claim 1, wherein the communication means of a first vehicle-to-vehicle communication device on the subject vehicle communicates with a second vehicle-to-vehicle communication device installed on another vehicle with an assistance of a third vehicle-to-vehicle communication device on yet another vehicle that relays communication of the information.

9. The vehicle-to-vehicle communication device of claim 1, wherein a combination of plural devices implements a collected function of all of the means of the device.

10. The vehicle-to-vehicle communication device of claim 1, wherein a combination of plural devices implements a whole function of the signal-processing means of the device.

11. The vehicle-to-vehicle communication device of claim 1, further comprising:

an image processing control unit for processing an image of the surrounding vehicles around the subject vehicle; and a distance detection control unit for detecting an inter-vehicle distance between the subject vehicle and the each of the surrounding vehicles around the subject vehicle, wherein the detection means detects the first information of the subject vehicle and the each of the surrounding vehicles around the subject vehicle at least based on information derived from the image processing control unit and the distance detection control unit.

12. A vehicle-to-vehicle communication device installed on a subject vehicle and organized with one or more vehicle-to-vehicle communication devices as a system, the vehicle-to-vehicle communication device comprising:

a detection means for detecting first information of the subject vehicle and each of surrounding vehicles around the subject vehicle;

a communication means for receiving second information of surrounding vehicles from another vehicle-to-vehicle communication device;

a report means for reporting various kinds of information;

a signal-processing means for processing the first information of the subject vehicle and of the another communication device and for making the report means report the information of the subject vehicle and each of the surrounding vehicles; and a map data retrieval means for retrieving map data;

wherein the detection means detects information of positions of the subject vehicle and each of the surrounding vehicles, wherein the report means includes a display means for displaying the various kinds of information as an image, wherein the signal-processing means processes and determines the position of the subject vehicle and the positions of each of the surrounding vehicles based on the information from the detection means of the vehicle-to-vehicle communication devices on the subject vehicle and other vehicles, wherein the signal-processing means controls the display means to display representation of the subject vehicle and each of the surrounding vehicles in an image of the map data when the image is processed by the signal-processing means with the map data retrieved by the map data retrieval means, and wherein the signal-processing means determines a type of the representation of each vehicle in the image of the map data based on a condition whether or not each vehicle is equipped with the device.

13. A method of controlling a vehicle-to-vehicle communication comprising the steps of:

detecting first vehicle information by a first vehicle;

receiving second vehicle information detected by a second vehicle;

processing the first vehicle information with the second vehicle information to prepare a report;

making the report available to an operator of the first vehicle;

retrieving map data;

combining the first vehicle information and the second vehicle information with the map data; and displaying the report by an image representing the map data, the first vehicle information and the second vehicle information, wherein the first vehicle information includes vehicle position and related information of the first vehicle and each of surrounding vehicles around the first vehicle, wherein the report includes each of the surrounding vehicles whether equipped with the device, and wherein the step of combining the first vehicle information and the second vehicle information with the map data comprises choosing representations of the vehicles based on an equipment of the device on the vehicles.

14. The method of claim 13 wherein the step of combining the first vehicle information and the second vehicle information with the map data comprises reflecting movement of the first vehicle, the second vehicle and the surrounding vehicles in a specified period of time.

15. The method of claim 13 wherein the step of combining the first vehicle information and the second vehicle information with the map data comprises determining positions of the vehicles by weighting accuracy of the first vehicle information and the second vehicle information.

16. The method of claim 13 wherein the step of combining the first vehicle information and the second vehicle information with the map data comprises determining positions of the vehicles with information having accuracy equal to or higher than a predetermined value.

17. The method of claim 13 wherein the step of combining the first vehicle information and the second vehicle information with the map data comprises determining positions of the vehicles exclusively with information having accuracy equal to or higher than a predetermined value.

18. The method of claim 13 wherein the step of combining the first vehicle information and the second vehicle information with the map data comprises arranging positions of the vehicles suitable to a portion of the map data where the positions of the vehicles indicate.

19. The method of claim 13 wherein the step of combining the first vehicle information and the second vehicle information with the map data comprises arranging positions of the vehicles suitably for distinguishing representation of the vehicles.

20. The method of claim 13 wherein the step of receiving the second vehicle information at the first vehicle is performed through a road side device when receiving the information.

21. The method of claim 13, wherein the receiving the second vehicle information at the first vehicle is performed through at least one other communication device installed on at least one other vehicle that is different from the first vehicle and the second vehicle.

22. The method of claim 13 wherein the step of controlling a vehicle-to-vehicle communication is executed on the vehicles having required function for totally achieving control of the vehicle-to-vehicle communication.

* * * * *